United States Patent [19]

Mathiesen et al.

[11] Patent Number: 4,565,549

[45] **Date of Patent: * Jan. 21, 1986**

[54] AQUEOUS SLURRY OF A SOLID FUEL AND A PROCESS FOR THE PRODUCTION THEREOF

[75] Inventors: Mait M. Mathiesen, Arild; Lars I. Gillberg, Lund; Karl M. E. Hellsten, Ödsmål; Gunvor B. T. Karlsson, Stenungsund, all of Sweden

[73] Assignees: AB Carbogel, Helsingborg; Berol Kemi AB, Stenungsund, both of Sweden

[ * ] Notice: The portion of the term of this patent subsequent to Oct. 29, 2002 has been disclaimed.

[21] Appl. No.: 492,196

[22] Filed: May 6, 1983

[30] Foreign Application Priority Data

May 7, 1982 [SE] Sweden ..... 8202879

[51] Int. Cl.[4] ..... C10L 1/32

[52] U.S. Cl. ..... 44/51; 44/77; 252/351

[58] Field of Search ..... 44/51, 77; 252/351; 406/47, 49, 195, 197

[56] References Cited

U.S. PATENT DOCUMENTS

| | | | |
|---|---|---|---|
| 2,346,151 | 4/1944 | Burk | 44/51 X |
| 2,359,325 | 10/1944 | McConnell | 44/51 X |
| 3,100,230 | 8/1963 | Mansfield | 252/351 |
| 3,168,350 | 2/1965 | Phinney | 44/51 X |
| 3,254,682 | 8/1970 | Booth | 302/66 |
| 3,762,887 | 10/1973 | Clancey | 44/51 X |
| 4,076,505 | 2/1978 | Dessau | 44/1 R |
| 4,094,810 | 6/1978 | Thomas | 44/51 X |
| 4,162,044 | 7/1979 | Manfroy | 241/16 |
| 4,162,045 | 7/1979 | Katzer | 241/16 |
| 4,209,301 | 6/1980 | Nicol et al. | 44/24 |
| 4,217,109 | 8/1980 | Siwersson | 44/51 |
| 4,242,098 | 12/1980 | Braun et al. | 44/51 |
| 4,302,212 | 11/1981 | Yamamura et al. | 44/51 |
| 4,358,293 | 11/1982 | Mark | 44/51 |
| 4,470,828 | 9/1984 | Yamamura et al. | 44/51 |

FOREIGN PATENT DOCUMENTS

| | | |
|---|---|---|
| 0077909 | 5/1983 | European Pat. Off. . |
| 1644942 | 8/1977 | Fed. Rep. of Germany . |
| 1308112 | 9/1962 | France . |
| WO83/00500 | 2/1983 | PCT Int'l Appl. . |

*Primary Examiner*—William R. Dixon, Jr.
*Assistant Examiner*—Margaret B. Medley
*Attorney, Agent, or Firm*—Gordon W. Hueschen

[57] ABSTRACT

An aqueous slurry of a solid fuel and a process for producing said slurry are described. The aqueous slurry consists of a highly concentrated slurry of a pulverized, carbonaceous material having a particle size of at most 0.5 mm, and 0.02–2% by weight of at least one additive. The solids content of the slurry is 65–90% by weight, preferably 70–80% by weight. The slurry is characterized in that the additive includes a water-soluble surface active compound which is an ethylene oxide adduct having the following formula:

$$RO(CH_2CH_2O)_nH$$

wherein R is an aliphatic or acyl group with 10 to 24 carbon atoms or a substituted aryl group with 12–54 carbon atoms; and n is at least 40 but less than 100; or n is 40–200 in which latter case the ratio of ethylene oxide units to the number of carbon atoms in the group R is 3.5–6.0 when R is an aliphatic or acyl group and 3.0–5.5 when R is a substituted aryl group. By adding the ethylene oxide adduct after wet milling and dewatering of the carbonaceous material, an aqueous slurry is obtained which is stable, i.e. it does not separate during transport and storage, as well as low-viscous, i.e. pumpable at a high solids content. In addition to the specific ethylene oxide adduct which preferably is added in a concentration of 0.05–0.8% by weight, other conventional additives, such as stabilizers, antifoaming agents, pH-modifying additives and antimicrobial agents may be added.

9 Claims, No Drawings

AQUEOUS SLURRY OF A SOLID FUEL AND A PROCESS FOR THE PRODUCTION THEREOF

The present invention relates to an aqueous slurry of a solid fuel in the form of a pulverized carbonaceous material and at least one surface active additive. The invention also relates to a process for producing such aqueous slurry.

The term "solid fuel" as used in the context of this invention comprises different types of carbonaceous materials, such as bituminous, anthracitic, sub-bituminous and lignitic coal, charcoal, petroleum coke or other solid refinery byproducts.

Present-day heat production is largely based on the combustion of liquid or gaseous fuels, and existing plants therefore are adapted to the transport, storage and combustion of fuel in these physical forms. Transition to lump coal would involve extensive reconstruction and new investments, and it therefore is a matter of course that a keen interest has been shown in different processes for converting coal into liquid or gaseous fuel products. In addition to a chemical conversion of coal into methanol or hydrocarbons, it has also been proposed to produce a slurry of coal powder in different liquids, such as methanol, oil, mixtures of water and oil, or water alone. Of these alternatives, a slurry of coal and water offers far greater practical and economic advantages than the others, primarily because this slurry has a high flash-point and that the raw material costs for the liquid carrier medium will be low.

Many demands are made on a coal/water slurry, but the most important requirement is that the slurry have a high carbon content and be homogeneous also after it has been stored for some time. Furthermore, it is important that the viscosity of the slurry be low to facilitate pumping and fine division of the slurry in the combustion chamber. The slurry must also have a low sensitivity to pH variations as well as a low corrosivity towards tanks, pipelines, pumps and nozzles.

It is already known to produce slurries of pulverized solid fuels and to stabilize these slurries in a greater or less degree by means of various additives. An example of prior-art technique is U.S. Pat. No. 4,217,109 which discloses a coal/water slurry containing a dispersant which, by selective adsorption, causes coal particles and particles of other material to be charged differently, whereby purification of the coal and also stabilization of the suspension is facilitated. The dispersant according to the U.S. patent specification is selected among polyelectrolytes or polyphosphates.

Moreover, it is already known from the published PCT application PCT/US80/01419 to produce a highly concentrated slurry of coal in water by controlling the particle size distribution of the coal in a specific manner and to add surface active chemicals imparting a specific surface charge to the coal particles. The surface active chemicals employed are commercially available dispersants. The characteristics of the slurry are highly dependent upon a combination of an exact particle size distribution and the surface charge of the individual particles, which is achieved by adding exact amounts of dispersant. In actual practice, however, it is extremely difficult to reproducibly achieve, on a commercial scale, the required exact particle size distribution, or to maintain the characteristics of the slurry at an increasing ionic contamination of the slurry due to, for example, corrosion of the equipment or leaching of the coal.

In addition, it is already known from French patent specification No. 1,308,112 to cause a viscosity reduction of low-concentrated coal suspensions by using an alkylene oxide adduct in which the hydrophilic part preferably consists of 5–35 ethylene oxide units.

British patent specification 1,429,934 concerns a process of dispersing a particulate material in a liquid by means of a block copolymer made up of blocks which are, respectively, soluble and insoluble in the liquid. Poly(t-butyl styrene) is mentioned as an example of a soluble block. The particulate material is highly fine-grained and, preferably, has a particle size of from 50 Å to 10 μm. One example of particulate material is carbon black.

U.S. Pat. No. 4,358,293, published on Nov. 9, 1982 and the corresponding EPC application 82300448.6, Publication No. 0057 576, published on Aug. 11, 1982, disclose aqueous coal dispersions wherein nonionic surfactants with at least 100 repeating ethylene oxide units are employed as dispersants. According to these references surfactants with less than 100 repeating ethylene oxide units are inoperative or contraindicated. This teaching is contrary to our own findings, as reported herein.

The present invention has as an object to improve the viscosity and stability of highly concentrated aqueous slurries of pulverized carbonaceous solid fuels. By highly concentrated aqueous slurries are here meant aqueous slurries having a solids content of 65–90% by weight, preferably 70–80% by weight.

To realize this object, there is incorporated in the aqueous slurry a special additive in the form of a water-soluble surface active compound having the following formula $$RO(CH_2CH_2O)_nH$$

wherein R denotes an aliphatic or acyl group comprising 10–24 carbon atoms or a substituted aryl group comprising 12–54 carbon atoms; and n is at least 40 but less than 100 or n is 40–200 in which latter case the ratio of ethyleneoxy units to the number of carbon atoms in the R group is 3.5–6.0 when R is an aliphatic or acyl group and 3.0–5.5 when R is a substituted aryl group.

By the term "surface active" is here meant that a 0.1% solution of the alkylene oxide adduct in water having a temperature of 20° C. has a surface tension below 50 dynes/cm, measured according to the Du Noüy ring method. Alkylene oxide adducts having a surface tension of 40–49 dynes/cm are especially suitable.

A surface active ethylene oxide adduct made up of a hydrophobic part and a hydrophilic part with the above-mentioned composition makes it possible to achieve a steric stabilization of the highly concentrated fuel slurry according to the invention in that the hydrophobic part of the ethylene oxide adduct is adsorbed to the surfaces of the fuel particles, while the hydrophilic part, the polyethylene oxide chain, of the ethylene oxide adduct binds a water layer to the surface of the fuel particle. If the surface of each particle is covered by adsorbed alkylene oxide adduct, each fuel particle in the aqueous slurry will be surrounded by such a bound water layer or casing. This water layer around each fuel particle reduces the internal friction in the aqueous slurry so that the particles can execute a sliding movement past one another which remains unaffected by the attractive forces between the particles. Furthermore, the steric stabilization according to the present invention is but little sensitive to variations in the level of concentration of different salts in the aqueous slurry.

The characteristic features of the invention will appear from the claims.

According to one aspect of the invention, there is thus produced an aqueous slurry of a solid fuel in the form of a pulverized carbonaceous material and 0.02–2% by weight of at least one additive, the solids content of the slurry being 65–90% by weight, and the aqueous slurry being characterized in that the additive comprises a water-soluble surface active alkylene oxide adduct with the following formula $$RO(CH_2CH_2O)_nH$$

wherein R denotes an aliphatic or acyl group consisting of 10–24 carbon atoms or a substituted aryl group comprising 12–54 carbon atoms; and n is at least 40 but less than 100 or n is 40–200 in which latter case the ratio of ethyleneoxy units to the number of carbon atoms in the R group is 3.5–6.0 when R is an aliphatic or acyl group and 3.0–5.5 when R is a substituted aryl group.

According to another aspect of this invention, there is provided a process for producing an aqueous slurry of a solid fuel in the form of a pulverized, carbonaceous material and 0.02–2% by weight of at least one additive, the solids content of the slurry being 65–90% by weight, characterized by the following steps:

(a) wet-milling a carbonaceous starting material together with water at a solids content of 20–50% by weight in at least one milling step;

(b) separating, if necessary, inorganic material of the carbonaceous starting material from the carbonaceous material of said starting material;

(c) dewatering the carbonaceous material to a solids content which is substantially equal to the solids content of the final slurry;

(d) adding to and distributing in the dewatered carbonaceous material the said additive comprising a water-soluble surface active alkylene oxide adduct with the following formula $$RO(CH_2CH_2O)_nH$$

wherein R denotes an aliphatic or acyl group comprising 10–24 carbon atoms or a substituted aryl group comprising 12–54 carbon atoms; and n is at least 40 but less than 100, or n is 40–200 in which latter case the ratio of ethyleneoxy units to the number of carbon atoms in the R group is 3.5–6.0 when R is an aliphatic or acyl group and 3.0–5.5 when R is a substituted aryl group.

It must be emphasized that the present invention, as has been mentioned before, relates to concentrated aqueous slurries, i.e. slurries having a solids content of at least 65–90% by weight, preferably 70–80% by weight. This means that the water constitutes but a minor part of the slurry and is present in a content below 35% by weight, preferably 20–30% by weight. The inventors have discovered that many of the properties and alleged advantages obtained by prior art technique concern relatively low-concentrated slurries having a water content of at least about 40% by weight, and that it is not possible to increase the solids content to above 65% by weight and, at the same time, retain sufficient pumpability and stability of the slurry.

However, it has now been surprisingly found that these problems can be eliminated by adding a particular water-soluble surface active compound which consists of an ethylene oxide adduct having a hydrophobic part and a hydrophilic part, said surface active compound being characterized in that the hydrophilic part consists of a polyethylene oxide chain with a chain length of either at least 40 but less than 100, suitably at least 50 but less than 100, and preferably 50–90 ethyleneoxy units, or 40–200, preferably 50–150 ethylenoxy units, in which latter case the ratio of ethyleneoxy units to the number of carbon atoms in the group R of the above formula is 3.5–6.0 when R is an aliphatic or acyl group and 3.0–5.5 when R is a substituted aryl group, i.e. the hydrophilic part consists of a hydrophilic chain having a given length. The most preferred range is 60–90 ethyleneoxy units. It has been found that the length of the hydrophilic chain specified above is an indispensable condition for achieving a stable and low-viscous, i.e. pumpable fuel slurry at a solids content exceeding 65% by weight.

The stability of the slurry, i.e. its resistance to separation of the water from the solids during storage and transport of the slurry, including vibration of the slurry, becomes greater with an increasing number of ethylene oxide units in the hydrophilic part, i.e. it increases with the length of the hydrophilic chain. If, however, the hydrophilic chain is too short (the number of ethylene oxide units is below 40), separation and sedimentation will occur if the slurry has been subjected to vibration for a few days. It has also been found that the sensitivity of the slurry to temperature is reduced as the length of the hydrophilic chain is increased.

In addition to the hydrophilic part as described above, the surface active compound according to the invention also comprises a hydrophobic part, which is adapted to absorption onto the surface of the pulverized carbonaceous material.

The compounds according to the present invention can be obtained by reacting in a well-known manner a suitable amount of ethylene oxide with a suitable organic compound made up of hydrogen, carbon and oxygen and having a hydrogen reactive with ethylene oxide.

Examples of suitable organic compounds of this type are decyl alcohol, lauryl alcohol, myristyl alcohol, cetyl alcohol, stearyl alcohol, eicosyl alcohol, oleyl alcohol, cyclododecanol, cyclohexane decanol, octyl phenol, nonyl phenol, dodecyl phenol, hexadecyl phenol, dibutyl phenol, dioctyl phenol, dinonyl phenol, didodecyl phenol, dihexadecyl phenol, trinonyl phenol, capric acid, lauric acid, myristic acid, palmitic acid, stearic acid, oleic acid, linoleic acid and arachidic acid.

To further illustrate the special surface active compound according to the invention, the following examples of useful compounds are given.

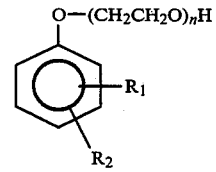

(II)

-continued

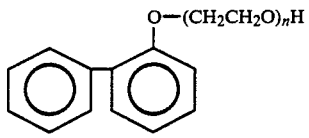

(III)

wherein $R_1$ designates an alkyl group, $R_2$ designates an alkyl group or hydrogen, an n is either at least 40 but less than 100, suitably at least 50 but less than 100, and preferably 50–90, or n is 40–200, preferably 50–150, in which latter case the ratio of ethyleneoxy units to the number of carbon atoms in the substituted phenyl group is 3.0–5.5. Disubstituted compounds are particularly preferred and especially those in which $R_1$ and $R_2$ are nonyl groups.

The concentration of additive in the aqueous slurry, such as the surface active compound according to the invention, amounts in total to 0.02–2% by weight, based upon the aqueous slurry. Preferably, the concentration of the surface active compound according to the invention is 0.05–0.8% by weight of the slurry.

In addition to the above-mentioned specific surface active compound according to the invention, the slurry may also incorporate other conventional additives, such as antimicrobial agents, antifoaming agents, pH-modifying additives, and conventional stabilizers increasing the effect of the surface active compound according to the invention or producing a further effect.

The addition of conventional stabilizers is especially suitable when the hydrophilic part of the dispersant is relatively short. Examples of conventional stabilizers are protective colloids, such as xanthan gum, cellulose derivatives, such as carboxy methyl cellulose, ethylhydroxyethyl cellulose, hydroxyethyl cellulose, clays, such as attapulgite, sepiolite, bentonite, aluminum hydroxide, silica gel, cellulose suspensions, carbon black, starch and starch derivatives.

If further additives are to be used, over and above the specific surface active compound, the rule is that the conventional stabilizer should be added up to a concentration of at most 1% by weight, preferably at most 0.2% by weight, while the antifoaming agent should be added up to a concentration of at most 0.1% by weight, all based upon the weight of the slurry. The pH-modifying additive which, preferably, is an alkali metal hydroxide, such as sodium hydroxide, is added in such an amount that the pH of the slurry is caused to lie on the alkaline side, for example above pH 10, thereby to eliminate corrosion problems in the transport and storage equipment.

Furthermore, the aqueous slurry according to the invention contains as the major component a solid fuel in the form of a pulverized, carbonaceous material. As has previously been mentioned, the carbonaceous material is selected among bituminous coal, anthracitic coal, sub-bituminous coal, lignitic coal, charcoal and petroleum coke. If one disregards the solids content that is conditioned by the additives, the content of the slurry of pulverized, carbonaceous material may be equated with the solids content of the slurry, i.e. it is 65–90% by weight, preferably 70–80% by weight, based upon the total weight of the slurry.

The pulverized carbonaceous material need not be subjected to any treatment in order to change its hydrophobicity. Rather, the surface of the carbonaceous material is preferably kept unmodified, i.e. it is not chemically reacted to modify its surface characteristics and contains preferably less than 0.5, more preferably less than 0.1% by weight, based on the carbonaceous material, of hydrophobating hydrocarbons, such as fuel oil.

The particle size of the pulverized carbonaceous material plays an important part regarding the stability of the slurry according to this invention. To arrive at an optimal particle size several considerations are required. First of all, impure, solid fuels, such as coal, must be concentrated to eliminate inorganic impurities from the organic material. The particle size must be adapted so that it will permit satisfactory release of the impurities. In the second place, fuel slurries should preferably have a particle size not exceeding 100–250 μm to ensure complete combustion of the fuel particles in the flame. It is also desirable to keep down that fraction of the particles which is greater than 100 μm, thereby to minimize wear of the burner and similar equipment for handling the slurry. In the third place, the particle size distribution must, of course, be such that it entails, to the greatest possible extent, a minimum water content, minimum viscosity and maximum stability of the slurry.

Owing to the favourable properties of the specific surface active compound according to the present invention, the last-mentioned requirement concerning the particle size distribution is not as critical as is normally the case in highly concentrated aqueous slurries of solid fuels, and the invention admits of certain fluctuations in the particle size distribution, as is normally the case under commercial production conditions, without detriment to the viscosity or stability of the slurry. More particularly, it has been found that for the present invention the particle size should lie within the range 0.1–350 μm, preferably 1–250 μm. For maximum results, however, the particle size should not exceed about 200 μm.

For some applications, such as the burning of the fuel slurry in a fluidized bed or the injection of the fuel slurry into blast furnaces, the particle size of the pulverized, carbonaceous material is not especially critical, and the fuel slurry may include relatively large particles, without causing any difficulties. However, one should not go beyond a particle size of about 0.5 mm because of the risk of particle sedimentation which may occur if the particles are too large.

The invention has been described above with reference to that aspect thereof which concerns an aqueous slurry of a solid fuel.

The process for producing an aqueous slurry according to the present invention will now be described in connection with a solid fuel in the form of bituminous coal. The basic technology is the same for other solid fuels, such as sub-bituminous, anthracitic and lignitic coal, charcoal and petroleum coke etc., even though these fuel types are not in every respect processed in the same manner. Thus, certain solid fuels do not require the purification step which is described and applied to the coal referred to below, whereas the mechanical properties of different types of coal in some cases necessitate a milling equipment which is different from the equipment described below for bituminous coal.

A suitable starting material is bituminous coal that has been crushed to a certain extent and subjected to primary concentration in conventional manner, such that the content of inorganic matter in the coal, exclusive of moisture, has been reduced to about 5–20% by weight. The resulting product is then reduced in conventional manner to a particle size suitable for a first milling step which preferably is a wet-milling operation in a ball or rod mill.

By this first milling step three objects are realized:

1. Milling to a maximum particle size providing for a sufficient release of inorganic impurities in the coal.

2. Milling to a maximum particle size suitable for the contemplated use, i.e. a size which can burn out completely in the reaction zone, for instance a flame.

3. Milling to a particle size distribution suitable for the rheological characteristics of the fuel.

The conditions that must be fulfilled to attain the objects 1 and 2 are laid down on one hand by the mineralogy of the coal and, on the other hand, by the method of application. As has been mentioned before, a particle size of about 0.5 mm should not be exceeded, and normally it does not exceed 350 μm. Usually, it is preferred that the maximum particle size be about 100–200 μm.

Regarding the particle size distribution, it is a well-known fact that the size distribution of a particle aggregation can be optimized in order to minimize the pore number of the particle aggregation, i.e. the volume not taken up by solid matter. The present invention makes no absolute demand for any specific distribution in order to obtain a composition having a low water content, low viscosity and satisfactory stability. Investigations of a number of coal types show tht, depending both on the type of the coal and on the milling method, different compositions of particle shapes can be identified in the particle aggregation after the milling operation. This means that there exists for every coal type and for every milling operation, i.e. the milling circuit and the mill types included therein, a given size distribution which gives an optimal water content and viscosity and which can be established by the expert.

What is more, the particle geometries of the composition may affect the rheology and stability. Thus, it is possible to select certain mill types for the mill circuit in order to give a dominant position to, for example, equiaxial grains or discoid and flake-like grains, thereby to influence the final properties of the composition in a manner favourable to each specific application.

It is, however, an important aspect of this invention that the stabilizing and viscosity-reducing chemical additives to produce useful fuels with low water contents are not critically dependent upon specific size distributions. On the other hand, it is propitious to produce, according to known principles, such size distributions as give a maximum content of solid matter in the composition, and further advantages are obtainable by controlling the particle shapes.

The tendency of different mill types to give different particle geometries may be exemplified as follows:

| | |
|---|---|
| Hammer mill: | Dominance of equiaxial particles on milling of bituminous coal. |
| Wet milling in rod mill: | Dominance of irregular pointed and needle-shaped particles upon milling of bituminous coal. |
| Szego mill: (from General Comminution, Inc. Toronto, Canada) | Flat flake-shaped particles upon milling of bituminous coal. |

Some examples of suitable size distributions are the following:

1. Bituminous coal from United Coal Companies, Virginia USA (Widow Kennedy Seam)

| | | |
|---|---|---|
| Composition: | Fixed carbon: | 65% |
| | Volatile components | 28% |
| | Mineral components | 7% |

The following particle size distribution has resulted in finished compositions containing a solid fraction of up to 83.5% (total fraction of solid matter, % by weight of dry matter):

| | | |
|---|---|---|
| Less than | 200 μm | 100% |
| " | 150 μm | 91% |
| " | 100 μm | 78% |
| " | 75 μm | 71% |
| " | 45 μm | 58.5% |
| " | 25 μm | 47% |

2. Bituminous coal from Cape Breton Development Co., Nova Scotia, Canada (Harbour Seam)

| | | |
|---|---|---|
| Composition: | Fixed Carbon: | 63.5% |
| | Volatile components | 34.0% |
| | Mineral components | 2.5% |

The following particle size distribution has resulted in finished compositions containing a solids fraction of up to 78% (% by weight of dry matter):

| | | |
|---|---|---|
| Less than | 200 μm | 100% |
| " | 150 μm | 91% |
| " | 100 μm | 78% |
| " | 75 μm | 71% |
| " | 45 μm | 58.5% |
| " | 25 μm | 47% |

In the most typical case, the first milling step uses wet milling in a ball mill and/or rod mill. This does not preclude the use of other conventional mill types which are known to the expert and can be selected depending upon the characteristic milling properties of each coal type. The mill circuit which comprises one or several mills and classification equipment, is designed in such a manner that the conditions 1–3 as previously mentioned are fulfilled. In order to attain a suitable size distribution the milling circuit must be designed in a special manner since it is only in exceptional cases that the passage through one mill or several mills of the same type results in a suitable distribution. In most cases, the best results are obtained with a mill circuit based upon a division into different fractions, whereby the natural tendency of the coal to give a specific size distribution can be counteracted.

One of the difficulties encountered in these milling operations resides in that their particle size distribution gives a concentration of particles in the intermediate range so that the distribution will be too narrow, which means that the volume concentration of solid matter will be insufficient. This can be remedied by designing the mill circuit for instance in the following manner.

Coal is introduced, together with water, into a ball mill for wet milling. The milling product which is coarser than the final product from the first milling step, is conducted to a sieve which allows material whose particle size is below the desired maximum size to pass. Coarse material which does not pass through the sieve, is conducted to a second ball mill where size reduction is effected to increase the fine fraction of the final milling product. A hydrocyclone disposed after the ball mill separates the milling product from the ball mill into a fine and a coarse fraction, and the coarser material is recycled to the ball mill. The fine fraction is recycled to the sieve, whereby the final milling product is obtained which has a maximum size determined by the sieve and which contains both coarser and finer particles within the desired range.

The above example is far from being the only conceivable solution of a milling circuit for the first milling step and merely is intended to show how a suitable milling product can be obtained by using conventional milling technology. A person skilled in the art and familiar with the above-described principles which are valid for particle sizes and particle size distributions, as well as the properties of the type of coal at his disposal, is capable of testing and constructing operational mill circuits based upon known mill types.

The milling product from the first milling step, which is suspended in an aqueous phase, may then if necessary be conducted to a separation process where inorganic components are separated from substantially organic solid fuel components. The separation process conventionally consists of froth flotation in one or more steps, implying either (i) that organic components are raised by utilizing their natural flotability or, should this be insufficient, by means of a flotation reagent, such as kerosene or fuel oil which enhance the flotability. At the same time, pyrite can be passivated by adding for example $FeCl_3$, calcium ions or other additives reducing the affinity of the pyrite to air bubbles. A purification carried out in this manner has been found to give, depending upon the type of coal, ash contents of 1-5% in coal concentrates; or (ii) that the flotation is conducted inversely such that the coal is passivated and inorganic components are floated off by means of hydrophobating additives which selectively render inorganic additives hydrophobic.

Flotation may also be carried out in part steps between intermediate milling steps for intermediate products to release further inorganic substance and increase the purity of the final concentrate.

Besides flotation, the purification process may also include other physical separation processes, such as high-intensity magnetic separation and other known purification processes that can be used for fine particles in the wet phase.

Flotation may result in certain changes in the particle size distribution, as compared with the milling product from the first milling step. A second milling step for a given part flow of concentrate particles must therefore be carried out in certain cases, primarily in order to compensate for the loss of the finest particles of the particle aggregation.

The choice of the mill type will depend upon the necessity of milling a given part quantity of material, usually 5–25% of the total quantity, to a given maximum particle size, and presents no difficulties to the expert who knows the desired final particle size distribution.

The concentrate from the first milling step, or from the second milling step, if any, has a solids content of about 20–50% by weight, usually about 25% by weight. The concentrate must therefore be dewatered to a water content which preferably is one or two percentage units lower than the water content of the final composition since the additives used are preferably added in the form of aqueous solutions.

Dewatering is normally conducted in two steps, i.e. thickening followed by filtering in either a vacuum filter or a filter press. In some instances, a flocculant may be present in the thickener, provided that it does not interact with the additives for the composition according to the invention.

When extremely low water contents are desired, for instance below 20% by weight, dewatering may be completed by admixing a dry, milled and sufficiently pure coal product.

After dewatering, there is added to the resulting filter cake one or more additives including at least the surface active compound according to the invention. As has been mentioned above, the additive is supplied in the form of an aqueous solution admixed to the filter cake. The mixing process and equipment are designed in such a manner that the mixture will be as homogeneous as possible, and such that the particle surfaces are covered as completely as possible by the additive.

After dewatering has been effected and the additive has been supplied, the composition is pumpable and is pumped to storage tanks for further transport to the user.

The use of the fuel slurry according to this invention should be obvious, but in addition to the self-explanatory transport and handling applications (the fuel slurry is pumpable, for instance for transport in pipelines), special mention is made of the following uses.

The fuel slurry can be burned directly in industrial burners, heating plants or combined power and heating plants for the production of steam and hot water. The fuel slurry according to the invention is capable of replacing the conventional fuels presently used, such as oil or coal powder, whereby a better fuel economy as well as considerable advantages in respect of handling and transport are obtained.

Combustion and gasification of the fuel slurry according to the invention can occur in plants operating under pressure, resulting in a better fuel economy when the fuel slurry is used instead of oil, and in a greater ease of handling when the fuel slurry is used instead of conventional solid fuels. Gasification in pressurized reactors of the Texaco type, combustion in pressurized fluidized beds, and injection of the fuel slurry at the tuyere level of blast furnaces may be mentioned as examples.

Of special importance to the usefulness of the fuel slurry according to the invention are the following characteristics.

The fuel slurry can be atomized, i.e. dispersing the fuel in burner nozzles or the like results in a minimum number of aggregations of individual particles. Such aggregation is counteracted above all by the special dispersant according to the invention.

The fuel slurry is pumpable also at increased shear rates upon injection through various types of spreaders and at high pressures when the slurry is injected against pressurized reactors.

The fuel slurry has a low water content, which is of great importance to combustion processes and especially important in the gasification in connection with the production of synthesis gas where far higher yields are obtained in that the water content of the fuel can be kept considerably below 30% by weight.

As a result of the purification step in the production process, the fuel slurry has but a low content of inorganic impurities, such as sulphur compounds and other mineral components.

To further illustrate the invention and its advantages the following Examples are given which, however, are not intended to restrict the invention. The pulverized carbonaceous material used in these Examples consisted of bituminous coal from the eastern USA, more particularly from United Coal Companies, Virginia, USA (Widow Kennedy Seam). The composition of this coal has been specified before. After wet milling in a rod mill and ball mill, particles were obtained which had a particle distribution that has also been mentioned before. The specific surface area of the coal powder was 4.5 $m^2/g$, determined according to the BET method by nitrogen adsorption.

EXAMPLES 1-9

The amounts of the respective additives, as stated in Table 1, were dissolved in 30 ml of water having a hardness of 1.2° dH, whereupon 70 g of coal powder were added and stirred with a glass rod for 1 minute. The appearance of the suspension was then judged according to a scale from 1 to 4 where 1=Dry ("solid")
2=Viscous. Unsatisfactory pumpability
3=Liquid. Suitable for pumping
4=Easy flowing. Excellent pumpability.

The suspension was then kept for 48 hours in a sealed beaker and then inspected especially for sedimentation stability.

In Table 1, Examples 1-9 concern coal slurries in accordance with the present invention whereas tests A-G are comparisons. The Examples clearly show the effect that is obtained if the ethylene oxide chain contains, in accordance with the present invention, the defined number of repeating units.

TABLE 1

| Example | Additive | Amount of additive (g) | Appearance after 48 hours (Points) |
|---|---|---|---|
| 1 | Nonylphenol + 40EO | 0.3 | 3 |
| 2 | Nonylphenol + 50EO | 0.3 | 3 |
| 3 | Nonylphenol + 70EO | 0.3 | 4 |
| 4 | Nonylphenol + 90EO | 0.3 | 4 |
| 5 | Dinonylphenol + 70EO | 0.3 | 4 |
| 6 | Dinonylphenol + 80EO | 0.3 | 4 |
| 7 | Dinonylphenol + 100EO | 0.3 | 4 |
| 8 | Dinonylphenol + 100EO | 0.1 | 3 |
| 9 | Cetyl/stearyl + 80EO | 0.3 | 4 |
| Comparison | | | |
| A | None | 0 | 1 |
| B | Nonylphenol + 8PO + 20EO | 0.3 | 2 |
| C | Dinonylphenol + 16PO + 20EO | 0.3 | 2 |
| D | Nonylphenol + 100EO | 0.3 | 2 |
| E | Nonylphenol + 120EO | 0.3 | 2 |
| F | Nonylphenol + 150EO | 0.3 | 1 |
| G | Dinonylphenol + 150EO | 0.3 | 2 |

Note: In Table 1 EO denotes "ethyleneoxy" and PO denotes "propyleneoxy".

EXAMPLES 10-14

Slurries were prepared from bituminous high volatile coal (ex Cape Breton Development Corporation, Sydney, Nova Scotia) milled to minus 200 micron size, water and dinonylphenol ethylene oxide adduct in accordance with Table 2.

| | |
|---|---|
| Coal: | 71.6% by weight |
| Water: | 28.0% by weight |
| Additive: | 0.4% by weight |

The viscosities of the slurries were measured at 451 reciprocal seconds shear rate in a Contrave Rheomat 115 viscometer. The results were evaluated and graded on a scale of 1 to 4, where:

1. denotes a viscosity of over 600 centipoise
2. denotes viscosity between 500 and 600 centipoise
3. denotes viscosities between 400 and 500 centipoise
4. denotes viscosities below 400 centipoise.

TABLE 2

| Ethoxylated dinonylphenol | | |
|---|---|---|
| Number of repeating ethyleneoxy units | Viscosity at 451($S^{-1}$) | Evaluation (1-4) |
| (H) 32 | 520 | 2 |
| (10) 40 | 428 | 3 |
| (11) 56 | 364 | 4 |
| (12) 72 | 312 | 4 |
| (13) 80 | 332 | 4 |
| (14) 96 | 338 | 4 |
| (I) 150 | 780 | 1 |

Viscosity figures over 500 are unsatisfactory.

What we claim and desire to secure by Letters Patent is:

1. An aqueous slurry consisting essentially of water, a solid fuel in the form of a pulverized, carbonaceous material, and 0.02-2% by weight of at least one additive, the solids content of the slurry being 65-90% by weight, and the aqueous slurry being characterized in that the additive consists essentially of a nonionic water-soluble surface active alkylene oxide adduct with the following formula $$RO(CH_2CH_2O)_nH$$

wherein R denotes an aliphatic or acyl group comprising 10-24 crbon atoms or a substituted aryl group comprising 12-54 carbon atoms; and n is at least 40 but less than 100.

2. A slurry as claimed in claim 1, characterized in that the alkylene oxide adduct has the general formula

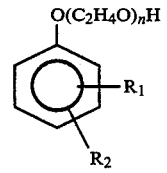

wherein $R_1$ designates an alkyl group, $R_2$ designates an alkyl group or hydrogen, n has the meaning stated above.

3. A slurry as claimed in claim 2, characterized in that the alkylene oxide adduct an alkyl or is dialkyl substituted phenyl compound.

4. A slurry as claimed in claim 1, characterized in that the alkylene oxide adduct is present in an amount of 0.05-0.8% by weight of said slurry.

5. A process for producing an aqueous slurry consisting essentially of water, a solid fuel in the form of a pulverized, carbonaceous material, and 0.02-2% by weight of at least one additive, the solids content of the slurry being 65–90% by weight, characterized by the following steps (a) wet milling a carbonaceous starting material together with water at a solids content of 20–50% by weight in at least one milling step;

(b) separating, any remaining inorganic material of the carbonaceous starting material from the carbonaceous material of said starting material;

(c) dewatering the carbonaceous material to a solids content which is substantially equal to the solids content of the final slurry;

(d) adding to and distributing in the dewatered carbonaceous material said additive consisting essentially of a nonionic water-soluble surface active alkylene oxide adduct with the following formula $$RO(CH_2CH_2O)_nH$$

wherein R denotes an aliphatic or acyl group comprising 10–24 carbon atoms or a substituted aryl group comprising 12–54 carbon atoms; and n is at least 40 but less than 100.

6. A process as claimed in claim 5, characterized in that the alkylene oxide adduct has the general formula

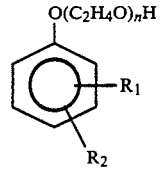

wherein $R_1$ designates an alkyl group, $R_2$ designates an alkyl group or hydrogen, and n has the meaning stated above.

7. A process as claimed in claim 6, characterized in that the alkylene oxide adduct is an alkyl or dialkyl substituted phenyl compound.

8. A process as claimed in claim 5, characterized in that the alkylene oxide adduct is present in an amount of 0.05–0.8% by weight of said slurry.

9. A slurry as claimed in claim 1, in which n is 50–90.

* * * * *

UNITED STATES PATENT AND TRADEMARK OFFICE

CERTIFICATE OF CORRECTION

PATENT NO. : 4,565,549

DATED : January 21, 1986

INVENTOR(S) : Mait M. Mathiesen, Lars I. Gillberg, Karl M. E. Hellsten and Gunvor B. T. Karlsson It is certified that error appears in the above-identified patent and that said Letters Patent is hereby corrected as shown below:

Col. 7, line 26; "tht" should read -- that --

Col. 12, line 42; "crbon" should read -- carbon --

Col. 12, line 57; after "hydrogen," insert -- and --

Col. 12, line 60; "an alkyl or is" should read -- is an alkyl or --

Col. 13, line 6; delete the comma "," after "separating"

Signed and Sealed this

*Twenty-seventh* Day of *May 1986*

[SEAL]

*Attest:*

DONALD J. QUIGG

*Attesting Officer*

*Commissioner of Patents and Trademarks*